US005784988A

United States Patent [19]

Burt, Jr.

[11] Patent Number: 5,784,988

[45] Date of Patent: Jul. 28, 1998

[54] METHOD AND APPARATUS FOR MOUNTING EMBROIDERY HOOPS

[76] Inventor: Robert S. Burt, Jr., P.O.Box 2117, Columbus, Miss. 39704

[21] Appl. No.: 775,098

[22] Filed: Dec. 30, 1996

[51] Int. Cl.[6] ..... D05B 39/00; D06C 03/08

[52] U.S. Cl. ..... 112/103; 38/102.2

[58] Field of Search ..... 38/102, 102.2, 38/102.4, 102.1, 102.91; 101/127.1; 160/374.1, 378, 380; 82/151, 170; 269/48.1, 140, 165, 217

[56] References Cited

U.S. PATENT DOCUMENTS

| | | | |
|---|---|---|---|
| 371,933 | 10/1887 | Gray | 160/374.1 |
| 3,216,717 | 11/1965 | Bagge et al. | 82/170 X |
| 4,746,131 | 5/1988 | Mathes | 82/170 X |
| 4,774,778 | 10/1988 | Williams | 112/78 X |
| 5,293,703 | 3/1994 | Coste et al. | 38/102.91 X |
| 5,433,158 | 7/1995 | Moore, III | 38/102.2 X |
| 5,590,613 | 1/1997 | Head | 38/102 X |

*Primary Examiner*—Ismael Izaguirre
*Attorney, Agent, or Firm*—Nixon & Vanderhye

[57] ABSTRACT

Embroidery hoops are mounted onto embroidery material using an embroidery hoop mounting device which can mount variably sized and shaped embroidery hoops for use with automated embroidery machines. The embroidery hoop mounting device utilizes a backing having a cam lock system on one side to adaptively hold the variously sized and shaped hoops during the mounting process. Handles are carried on the opposite side of the device for manipulating the device to engage the hoops with one another and with margins of the embroidery material between the hoops.

15 Claims, 3 Drawing Sheets

METHOD AND APPARATUS FOR MOUNTING EMBROIDERY HOOPS

TECHNICAL FIELD

This invention generally relates to devices used in the commercial embroidery industry. More particularly, the invention relates to a method and apparatus for mounting embroidery hoops onto embroidery material so that the material may be embroidered by an automated embroidery machine.

BACKGROUND

In the embroidery industry, before embroidery material is embroidered by an automated embroidery machine, a sewing machine, or the like, the portion of the material which is to be embroidered must first be placed within a matched pair of embroidery hoops. The matched pair of embroidery hoops is comprised of one embroidery hoop which is diametrically larger than the other so that when the two hoops are properly mounted on embroidery material, the diametrically smaller hoop fits very tightly inside the inner periphery of the diametrically larger hoop with the embroidery material pinched between the hoops. It will be recognized that embroidery hoops are not only circular in shape, but may also be generally rectangular, "D-shaped," or otherwise.

The primary purpose of mounting embroidery hoops onto the embroidery material is to ensure that the area of the material to be embroidered is stretched tightly and evenly. The embroidery material must be evenly and tightly stretched so that when the embroidery operation is complete and the hoops are removed, the embroidery is even and not distorted. A second reason for using embroidery hoops with the material is to facilitate easy material handling during the embroidery operation. Furthermore, many automated embroidery machines require the use of hoops to operate properly.

Generally, there are two ways in which embroiderers mount the embroidery hoops onto embroidery material. The first way involves the use of very large mechanical presses which require a custom set of dies for each particularly sized and shaped hoop. To use a press to mount embroidery hoops, the press user attaches to the press the proper custom die set for the hoop to be mounted. The first hoop of the embroidery hoop pair is placed on the custom die set. Then the embroidery material is properly positioned over the second hoop of the embroidery hoop pair. Finally, the mechanical press forces the first hoop into the second hoop with the embroidery material securely held between the hoops. The embroidery material is then ready to be embroidered by an automated embroidery machine or the like.

To use the mechanical presses, a press user must purchase a custom set of dies to fit each of the variously sized and shaped hoops the embroider expects to use in the embroidery operation. Thus, one significant disadvantage of using presses to mount embroidery hoops is the very high combined cost of the press and the custom die sets. Because of the high cost and the size of the machines, the presses are generally suitable for large scale commercial embroiderers only.

Another significant disadvantage to using presses to mount hoops is that should the embroiderer decide to change to a different size or shape hoop for which the embroiderer does not have a custom die set, the embroiderer must order a new custom die set for the new hoop before continuing operation. Obviously, every time the embroiderer wishes to change to a new hoop, the embroiderer must order a new die set to fit the new hoop. Each such change in size or shape causes the embroiderer to incur additional monetary costs in purchasing the new custom die set, as well as a production delay while waiting for the custom die set to be delivered.

The second general way in which embroidery hoops are mounted onto embroidery material is to perform the mounting by hand alone. To mount embroidery hoops by hand, the area of the material to be embroidered is positioned over the outer embroidery hoop. Next, the embroiderer places the inner ring over the material and the outer ring and, then, manually forces the inner ring into the outer ring using only the embroiderer's hands.

The advantage of mounting embroidery hoops by hand alone, as compared to press mounting, is the substantial cost savings realized by not purchasing the press and its required custom dies sets (not to mention the general maintenance costs of the press). However, there are at least three significant disadvantages to mounting embroidery hoops by hand alone. First, mounting by hand alone almost invariably results in uneven stretching of the embroidery material, or embroidery material which is not stretched tightly enough, due to the application of uneven force by the person mounting the hoops. When the material is unevenly stretched, or not stretched tightly enough, the embroidery will be a distorted version of the desired end product. If the distortion is significant enough, the embroidered material may have to be discarded as defective. Obviously, if the embroiderer must discard many distorted embroidered products, the embroiderer's costs of doing business will increase significantly, thereby affecting the embroiderer's ability to effectively compete in the marketplace.

The second significant disadvantage to mounting embroidery hoops by hand alone is the physical effect that the mounting operation has on the individual mounting the hoops. Where an individual is manually mounting hoops for many hours a day, as is typical in the commercial embroidery industry, the individual may fall victim to repetitive stress injuries, such as carpal tunnel syndrome or other maladies. In particular, manual hoop mounters are susceptible to inflammation of the hands and wrists due to the tremendous force repetitively inflicted on the heel of the hand. These injuries may affect an embroiderer's competitiveness by increasing the embroiderer's medical costs, or otherwise.

Finally, the embroidery hoops are more susceptible to breakage when they are mounted by hand alone. The breakage typically results from the uneven pressure applied to the hoops. Hoop breakage is another cost which may affect the embroiderer's marketplace competitiveness, and thus is an undesirable effect of mounting by hand alone.

DISCLOSURE OF THE INVENTION

It is an object of the present invention to overcome, or at least substantially mitigate, the aforementioned problems of mounting embroidery hoops on embroidery material, and particularly to provide an apparatus for mounting embroidery hoops onto embroidery material which is very flexible, and yet simple and inexpensive.

The term "embroidery material" is to be understood as meaning any material which is embroidered using embroidery hoops, and is not limited to garments worn by individuals.

The present invention provides an embroidery hoop mounting device for simply and flexibly mounting embroidery hoops onto embroidery material in a manner which ensures that the material fits evenly and tightly between the paired hoops. The mounting device may have a plurality of cam locks connected to a preferably rigid backing made of a suitable material, preferably extruded acrylic. The plurality of cam locks, along with any hardware necessary to connect the cam locks to the backing, comprise a cam lock system which can be adjusted to fit variously sized and shaped embroidery hoops. Each cam lock may be connected to the backing in any suitable manner such as by way of a screw and nut assembly which projects through the cam lock and the backing. Whatever method is used to connect the cam lock to the backing should facilitate easy tightening and loosening by manual force to permit quick adjustment of the cam lock position or angle of rotation by the user of the mounting device. A wing nut and appropriately matched screw are an example of one such method of connection. Other such methods of connection can be integrated into the cam lock itself, thereby eliminating the need to have other connecting hardware. It will be recognized that there are many other ways to appropriately connect the cam lock to the backing in a manner consistent with the present invention, and the way described here is but one of many alternatives. Moreover, a particular method of connection is not necessary to practice the present invention so long as the selected method is chosen is sufficient to connect a cam lock to the backing to accomplish the intended purpose of holding an embroidery hoop in place for mounting on the embroidery material.

It is also contemplated that instead of having all cam locks capable of being repositioned with respect to the backing, one or more cam locks may have a fixed position on the backing with the remaining cam lock or locks continuing to be repositionable on the backing. Furthermore, the stationary cam lock or locks may continue to be rotatable or, instead, the lock or locks may be rotatably fixed, and thereby not capable of rotation.

The backing may also be shaped so that one or more portions of it protrude from the remainder of the backing on the side which the cam lock or locks are connected. In this manner, each such protruding portion of the backing may perform the same function as a positionally and rotatably fixed cam lock. It will be appreciated that the cam lock or locks, along with any hardware necessary to connect the cam lock or locks to the backing, and the protruding portion or portions of the backing comprise the cam lock system.

The cam locks may, but need not, be shaped so that if the user rotates a cam lock, the cam lock will engage an embroidery hoop with more or less force depending on the original position of the cam lock and the subsequent direction of rotation. The cam locks may be advantageously shaped so that one side has an arc radius different than an arc radius along another side. For example, one side of a cam lock may have an arc radius of four inches while the other side has an arc radius of one and one-fourth inches. It will be recognized that these dimensions may be increased or decreased in proportion to each other or independently of each other. It will be further be recognized that the particular shape may vary, e.g., even a completely round shaped cam lock, for example, is contemplated by the present invention. Further, one or more spring-loaded pins having bullet noses may be provided on the hoop contacting surfaces of the cam locks. This will accommodate small size differences among hoops of the same size. The only requirement of the cam lock size or shape is that the cam lock be suited for its purpose of holding an embroidery hoop in place sufficiently so that the hoop may be mounted to the embroidery material.

There may be one or more slots in the backing to permit one or more cam locks to be selectively positioned with respect to the backing. In one embodiment of the present invention, the backing has three linear slots which advantageously permit the connection of four cam locks to the backing. One slot extends generally in the longitudinal direction conveniently along the longitudinal center line of the backing. The remaining two slots extend generally perpendicular to the longitudinal slot along a common transverse line, one transverse slot on each side of the longitudinal slot. The slots may, but need not, extend completely through the backing. Further, the purpose of a slot may be accomplished by a number of variously positioned, spaced holes in the backing which permit one or more cam locks to be variably positioned on the backing.

In one embodiment of the present invention, two handles are attached to the side of the backing opposite the cam locks and which permit the user to easily grasp and manipulate the mounting device. It will be recognized that any possible arrangement of one or more handles, or similar grasping utensils, such as knobs or the like, will facilitate the purpose of the handles described here and are thereby within the scope of the present invention.

It is another object of the present invention to provide a method of mounting embroidery hoops on embroidery material which is inexpensive, yet simple and flexible. According to the present invention, a user wishing to mount a matched pair of embroidery hoops onto embroidery material so as to hold the embroidery material between the hoops in a tight and even fashion will adjust one or more cam locks by either moving the cam lock along a slot in the backing, or by rotating the cam lock, or both. The user will adjust the cam lock system so that the cam lock system holds an embroidery hoop in place with sufficient force to permit the mounting device to be manipulated for its intended purpose without the embroidery hoop becoming disassociated from the mounting device. With the hoop properly placed on the mounting device, the user will then place the embroidery material, with appropriate backing if necessary, over the second embroidery hoop. The user will then position the first embroidery hoop over the embroidery material and second hoop using the mounting device. Finally, the user will apply sufficient force to the mounting device so that the embroidery material is tightly pinched between and held in place by the pair of embroidery hoops. With the embroidery hoops properly mounted on the embroidery material, the embroidery material is then ready for an automated embroidery machine, or the like, to sew the desired embroidery onto the embroidery material.

Mounting embroidery hoops using the mounting device has several advantages over the other methods of mounting hoops discussed above. As compared with mechanical presses, the present invention is drastically less expensive because the presses are large-scale machines, whereas the present invention is a hand-held device of relatively simple construction. Furthermore, the presses utilize custom die sets wherein each set is designed to fit only one size and shape embroidery hoop. However, the present invention's rotating and positionally adjustable cam locks permit the mounting device to fit variously sized and shaped hoops without the need to purchase other adaptive devices. Finally, if a press user wishes to change the size or shape of hoop being used, the user must halt the press, switch to another custom die, and restart the press. With the present invention, the user can simply adjust one or more cam locks to fit the new hoop in much less time and with much less difficulty than with the press.

The present invention also has several advantages over the method of mounting hoops by hand alone. First, the present invention ensures that the force applied by the user is evenly distributed around the embroidery hoop, thereby resulting in evenly and tightly stretched embroidery material. This prevents distortion in the final embroidered product. Second, the present invention contemplates the use of handles, or similar devices, which substantially reduce or eliminate any repetitive stress injuries which may be caused by mounting hoops by hand alone. Third, because the present invention applies an evenly distributed force to the embroidery hoops, the hoops are much less susceptible to breakage.

In a preferred embodiment according to the present invention, there is provided in embroidery hoop mounting apparatus comprising a backing, a cam lock system adjustably carried by the backing on one side thereof for engaging the periphery of an embroidery hoop and a handle connected to the backing on an opposite side thereof for displacing the backing and the cam lock system relative to the embroidery hoop to releasably secure the embroidery hoop to the cam lock system.

In a further preferred embodiment according to the present invention, there is provided a method of mounting embroidery hoops using an embroidery hoop mounting apparatus having a backing and a cam lock system carried by the backing, comprising the steps of placing embroidery material over a first embroidery hoop, adjusting the cam lock system about a periphery of a second embroidery hoop so that the second embroidery hoop is held in place by the cam lock system on the backing, positioning the cam lock system on the side of the embroidery material opposite the first embroidery hoop and displacing the cam lock system and backing with the second embroidery hoop carried thereby and the first embroidery hoop with material thereon relative to one another to connect the first and second embroidery hoops to each other with the embroidery material between the first and second embroidery hoops.

BRIEF DESCRIPTION OF THE DRAWINGS

The present invention will now be explained further by way of example and with reference to the accompanying drawings, of which.

BEST MODE FOR CARRYING OUT THE INVENTION

Figure 1:
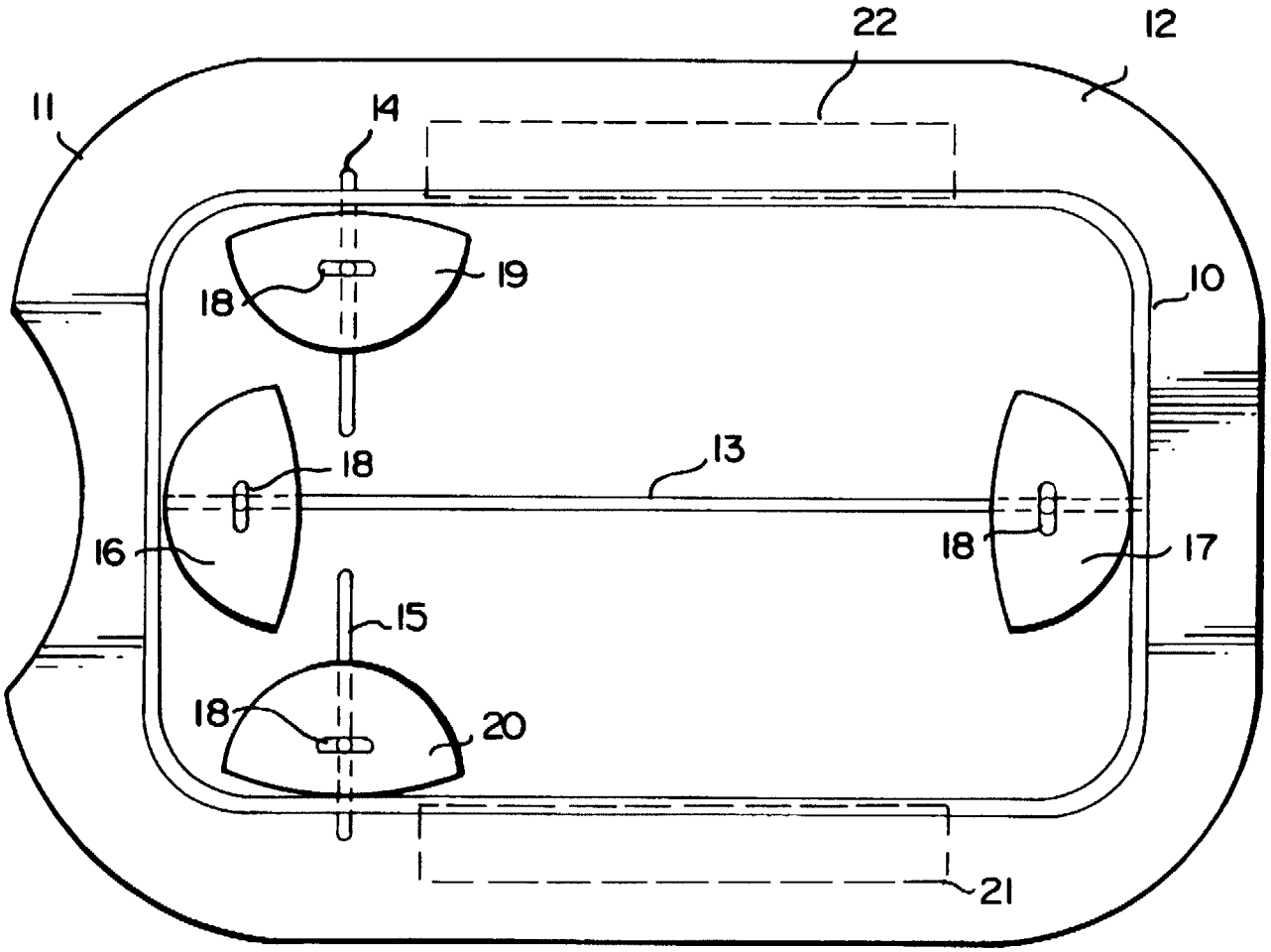
FIG. 1 is a front elevational view of an apparatus for mounting embroidery hoops in accordance with the present invention and with a representative embroidery hoop shown on the cam lock side thereof.

Referring to FIG. 1, there is illustrated a representative embroidery hoop 10 positioned on an embroidery hoop mounting device 11 constructed according to the present invention. The backing 12 of the mounting device 11 has a slot 13 formed through the backing 12. Slots 14 and 15 are also formed through backing 12 and extend generally perpendicularly to slot 13 with slot 14 on one side of slot 13 and slot 15 on the other side of slot 13. Backing 12 is preferably formed of extruded acrylic or other suitable substantially rigid material.

Figure 2:
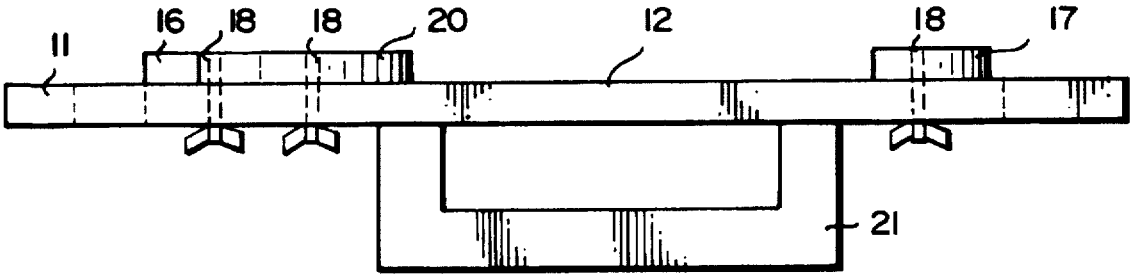
FIG. 2 is a rear elevation view thereof.

Referring to FIGS. 1 and 2, cam locks 16 and 17 are each connected to backing 12, preferably by a nut and bolt assembly 18 which fits through a hole in each cam lock and through slot 13. By tightening or loosening the nut and bolt assembly 18 of a particular cam lock, the user can reposition or rotate the cam lock as desired. Cam locks 19 and 20 are each connected to backing 12 through slots 14 and 15, respectively, in the same manner as that described for cam locks 16 and 17. Each nut and bolt assembly 18 is preferably a wing nut and matched bolt whereby easy tightening and loosening without the use of tools is effected. Cam locks 16, 17, 19 and 20, along with the nut and bolt assembly 18 for each cam lock, thus comprise the cam lock system for the mounting device shown in FIGS. 1 and 2.

Handles 21 and 22 are attached to backing 12 on the side opposite the cam locks to facilitate easy use and manipulation of the mounting device 11 by the user. Handles 21 and 22 may be made of wood, plastic or other suitable material. Other handle shapes, such as knobs, may be used.

Figure 3A:
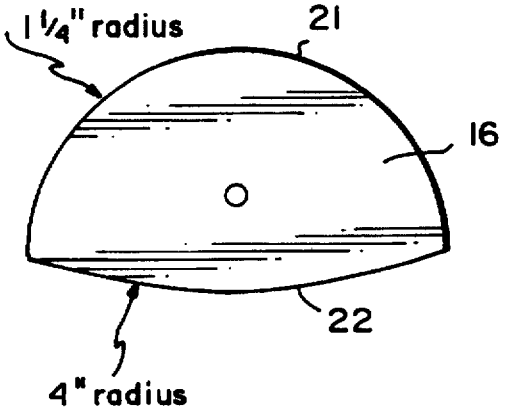
FIGS. 3*a* and 3*b* are front and side elevational views, respectively, of a cam lock.
Figure 3B:
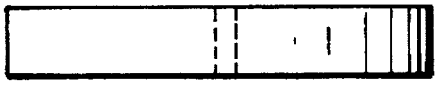

FIGS. 3*a* and 3*b* illustrate an individual cam lock. As shown in FIG. 3*a*, one side of the cam lock has an arc radius 21, e.g., of approximately one and one-fourth inches while the other side has an arc radius 22, e.g., of approximately four inches. Cam locks 16, 17, 19 and 20 are made of HDHP plastic or other suitable material.

Figure 4:
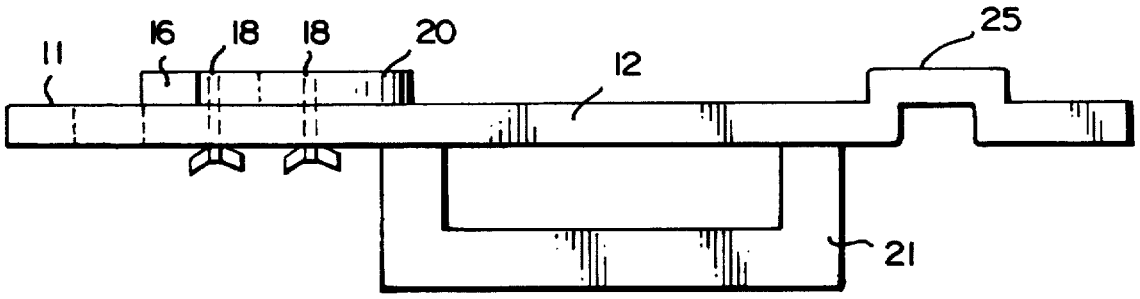
FIG. 4 is a view similar to FIG. 2 illustrating a further form of the invention.

Referring now to FIG. 4, it will be appreciated that there is illustrated a further form of the embroidery hoop mounting device hereof wherein at least one of the cam locks is fixed at a predetermined position to the backing 11. To accomplish this, the backing 11 may be preformed with a bump-out 25 on the cam lock side of the device. This bump-out may comprise a separate element fixed, for example, by adhesive to the backing 11 or may comprise an integral projection, as illustrated, of the backing 11. In the illustrated form, the remaining cam locks 16, 19 and 20 are similar as in the previously described embodiment.

From the foregoing description, the cam locks engage the inner periphery of the embroidery hoop and enable such hoop to be inserted within the periphery of a second embroidery hoop over which the embroidery material has been laid so that the material is disposed between the hoops. It will also be appreciated, however, that the cam locks can be arranged to engage the outer periphery of one of the embroidery hoops. Thus, by laying the embroidery material over the inner embroidery hoop and pressing the outer hoop onto the inner hoop, the embroidery material may similarly be disposed between the two hoops.

To use the present invention, for example, to dispose an inner embroidery hoop within the periphery of an outer embroidery hoop over which embroidery material has been laid, the cam locks are first adjusted to the interior size of the inner embroidery hoop. For example, one or more of the cam locks may be disposed along the longitudinal lateral slots and secured in an adjusted selected position to accommodate the particular size or shape of the inner embroidery hoop. The orientation of one or more of the cam locks about their pivotal axes, i.e., the screw assemblies and/or location along the slots can be adjusted enabling the contact points along the various cam locks to engage the inner peripheral surface of the inner embroidery ring with sufficient force such that the interior hoop can be manipulated with the mounting apparatus hereof. Once the cam locks are adjusted, the apparatus can be manipulated by using handles 22 such that the cam locks are received within the interior periphery of the embroidery hoop. The frictional engagement between the cam locks and the embroidery hoop is typically sufficient to enable the embroidery hoop to be lifted and manipulated by the mounting apparatus. With the embroidery material draped over the second embroidery hoop and with the embroidery hoops being generally complementary in shape and size relative to one another, it will be appreciated that the inner embroidery hoop carried by the mounting apparatus can be inserted within the outer embroidery hoop such that the two hoops lie in a common plane. By inserting the embroidery hoop into the larger hoop, it will be appreciated that the embroidery material is disposed between the two hoops and that the inserting motion renders the material within the inner hoop taut as necessary for accurate embroidery. The two hoops with the embroidery material therebetween can then be removed from the mounting apparatus and the embroidery can proceed in conventional fashion. To accommodate small differences that can be found in hoops of the same normal size, the cam locks may have one or more spring-loaded pins, preferably having bullet noses projecting through the surfaces of the cam locks engaging the embroidery material and the outer hoop. Consequently, a tight fit can be achieved notwithstanding slight differences in hoops nominally of the same size.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An embroidery hoop mounting apparatus comprising:

a backing;

a cam lock system adjustably carried by said backing on one side thereof for engaging the periphery of an embroidery hoop; and a handle connected to said backing on an opposite side thereof for displacing said backing and said cam lock system relative to the embroidery hoop to releasably secure the embroidery hoop to said cam lock system.

2. Apparatus according to claim 1 wherein said cam lock system is comprised of a plurality of cam locks connected to said backing at spaced locations therealong.

3. Apparatus according to claim 2 wherein said cam locks are rotatably connected to said backing for adjustably engaging the embroidery hoop.

4. Apparatus according to claim 2 including fasteners cooperable between said backing and said cam locks for securing said cam locks along said backing at selected adjustable locations enabling securement of embroidery hoops of different sizes and shapes to said backing.

5. Apparatus according to claim 1 wherein said cam lock system is comprised of at least one positionally fixed cam lock.

6. Apparatus according to claim 1 wherein said cam lock system is comprised of at least one portion of said backing extending from the remainder of said backing.

7. Apparatus according to claim 1 wherein said cam lock system is comprised of a plurality of cam locks connected to said backing at spaced locations therealong, at least one of said cam locks having first and second discrete surfaces spaced from one another along said cam lock, said one cam lock being adjustably connected to said backing for engaging one of said first and second surfaces with the embroidery hoop.

8. Apparatus according to claim 7 wherein said first and second surfaces are arcuate and have different radii.

9. Apparatus according to claim 7 including fasteners cooperable between said backing and said cam locks for securing said cam locks along said backing at selected adjustable locations enabling securement of embroidery hoops of different sizes and shapes to said backing.

10. Apparatus according to claim 1 wherein said cam lock system is comprised of a plurality of cam locks connected to said backing at spaced locations therealong, each of said cam locks having first and second discrete surfaces spaced from one another along said cam lock, each cam lock being adjustably connected to said backing for engaging one of said first and second surfaces to the embroidery hoop.

11. A method of mounting embroidery hoops using an embroidery hoop mounting apparatus having a backing and a cam lock system carried by the backing, comprising the steps of:

placing embroidery material over a first embroidery hoop;

adjusting the cam lock system about a periphery of a second embroidery hoop so that the second embroidery hoop is held in place by the cam lock system on the backing;

positioning said cam lock system on the side of the embroidery material opposite the first embroidery hoop; and displacing said cam lock system and backing with the second embroidery hoop carried thereby and the first embroidery hoop with material thereon relative to one another to connect the first and second embroidery hoops to each other with the embroidery material between the first and second embroidery hoops.

12. The method according to claim 11 including adjusting said cam lock system about the inner periphery of the second embroidery hoop.

13. The method according to claim 11 including adjusting the cam lock system about the outer periphery of the second embroidery hoop.

14. The method according to claim 11 including adjusting the cam lock system to fit hoops of different sizes.

15. The method according to claim 11 including adjusting the cam lock system to fit hoops of different shapes.

* * * * *